US006900004B2

(12) United States Patent
Satake

(10) Patent No.: US 6,900,004 B2
(45) Date of Patent: May 31, 2005

(54) CONCENTRATED COLOR DEVELOPER COMPOSITION USED FOR SILVER HALIDE PHOTOGRAPHIC SENSITIZED MATERIAL AND PROCESSING METHOD BY USE THEREOF

(75) Inventor: Wataru Satake, Hino (JP)

(73) Assignee: Konica Corporation (JP)

( * ) Notice: Subject to any disclaimer, the term of this patent is extended or adjusted under 35 U.S.C. 154(b) by 108 days.

(21) Appl. No.: 10/606,490

(22) Filed: Jun. 26, 2003

(65) Prior Publication Data

US 2004/0067458 A1 Apr. 8, 2004

(30) Foreign Application Priority Data

Aug. 9, 2002 (JP) ..... 2002-232569

(51) Int. Cl.[7] ..... G03C 7/413

(52) U.S. Cl. ..... 430/466; 430/486; 430/491; 430/492

(58) Field of Search ..... 430/466, 486, 430/491, 492

(56) References Cited

U.S. PATENT DOCUMENTS 6,413,703 B1 * 7/2002 Tappe et al. ..... 430/466

FOREIGN PATENT DOCUMENTS

GB 1293654 10/1972
WO WO/02/25371 A1 3/2002

OTHER PUBLICATIONS

European Search Report EP 03 25 4880.

* cited by examiner

*Primary Examiner*—Hoa Van Le
(74) *Attorney, Agent, or Firm*—Muserlian, Lucas and Mercanti

(57) ABSTRACT

A one-part photographic developing concentrate comprising: (i) a paraphenylene diamine color developing agent; and (ii) a water-soluble organic solvent, wherein a molar ratio of sodium ion to potassium ion is at least 3, and a molar ratio of sulfate ion to carbonate ion is at least 0.25.

6 Claims, 1 Drawing Sheet

CONCENTRATED COLOR DEVELOPER COMPOSITION USED FOR SILVER HALIDE PHOTOGRAPHIC SENSITIZED MATERIAL AND PROCESSING METHOD BY USE THEREOF

TECHNICAL FIELD

The present invention relates to a concentrated color developer composition used for silver halide photographic materials (hereinafter, also denoted simply as photographic sensitized materials or simpler still as photographic materials) and a processing method by use thereof, and in particular, to a concentrated color developer composition exhibiting improved fluctuation of oxidation-reduction potential even after storage at relatively high temperature, leading to superior developing performance of continuous processing developing reduction capability, that is, reduced variation in gamma balance even when used as a replenisher after storage, and a processing method by use thereof.

BACKGROUND

Photographic color developer compositions are used for processing color photographic film or paper to produce desired images. In general, such a composition contains a color developing agent as a reducing agent, for example, 4-amino-3-methyl-N-(2-methanesulfonamidoethyl)aniline, forming a desired dye upon reaction with a dye forming coupler. U.S. Pat. Nos. 4,892,804, 4,876,174, 5,354,646 and 5,660,974 describe such various color developer compositions.

Generally, to replenish processing components which have been consumed in reaction or carried out by processed photographic material, a color developer replenishing solution is supplied to a color developing solution in a color developing tank. Such replenishment is designed to maintain a prescribed developing capability and stability of the color developing agent.

A color developer replenishing solution is supplied in the form of at least three separated components (or concentrated compositions), which are usually mixed immediately before use. Separated plural parts are often supplied to maintain chemical reactivity and solubility of ingredients. Stocking these together in solution under alkaline conditions results in deterioration or reaction with each other. The components comprise one containing a color developing agent, another one containing material to maintain alkalinity and one containing a compound such as an anti-oxidizing agent. A homogeneous color developing solution can usually be obtained by mixing all of these components with water.

In the photographic industry, reducing the number of such components used for preparation of the replenishing solution has been desired to reduce bothersome handling. Solutions ready to use as such, so-called ready-to-use type solutions, a concentrated composition or a powdery mixture has been commercially available in this field of technology. For example, EP-A No. 0793141 (hereinafter, the term EP-A refers to European Patent Application Publication) describes a color developer composition comprised of two components, which can be supplied in solid or liquid form.

In these ready-to-use type solutions, which are superior in ease of use, all of the ingredients are prepared in specific concentrations in which a large amount of water is contained, resulting in increased cost of manufacture, transport and storage.

In the photographic industry, therefore, it has been and still is desired to provide a photographic processing composition in a concentrated form (including a color developer composition) so that a manufacturer or consumer can enjoy reduced cost for transport or storage of basically a large amount of water, thereby rendering smaller containers effective. Further desired in the photographic industry is a composition which is usable immediately after removing it from the container (for example, known as an automatically replenishing processor), without the need of mixing various ingredients (thereby reducing errors in mixing).

When comparing a liquid concentrate with a solid mixture (e.g., powder, tablet), the liquid concentrate is more convenient to use but is more expensive for packaging. Although powder can be highly concentrated, it is difficult to supply stable powder for respective photographic chemical compositions. Further, powder has problems such as creating dust, and the necessity of separately packaging and complicated operations for measuring and mixing. Further, it takes a lot of effort and time to complete dissolution into a uniform solution.

Another concentration form known in the art is a paste or slurry of chemicals, as described in EP-A Nos. 0204372 and 0800111. However, such a mixture has defects in that it exhibit insufficient uniformity and retarded dissolution of its solid components.

Recently, to overcome the foregoing problems, a single component type color developer composition (a single mixture) has become commercially available. However, precipitates (such as slurry) or plural solvent phases exist in such a composition, making it necessary to conduct sufficient stirring or mixing prior to use.

Accordingly, strongly desired has been a single component type color developer composition (a single mixture) which is concentrated homogeneously and stably. Such a concentrated composition not only reduces costs to transport a solution diluted with a large amount of water and to stock the solution, but it also eliminates the necessity to mix plural parts or stir plural phase compositions to, providing a product desired by consumers.

Specifically CD-3 (4-amino-3-methyl-N-(2-methanesulfonamidoethyl)aniline, which is used for a color developing agent of color paper, exhibits low solubility, leading to the assumption that forming a single component is difficult. To solve these problems, proposed are methods such as using CD-3 free amine described in JP-B 3-150131 (hereinafter, the term JP-B refers to Examined Japanese Patent Publication), and prescribing a molar ratio of a Na salt and a K salt described in WO 02/25371. Employing these methods, it becomes possible to provide a single component kit (or called as one-part photographic developing concentrate) with an improved low temperature deposition, resulting in no precipitates.

However, in a single solution kit, fluctuation of development processing levels in long term storage can be taken for granted in addition to the foregoing low temperature deposition. This is inferred from oxidation-reduction level fluctuation of the solution after storage, and consequently, is encountered for the first time with a single solution kit in which all of the components are contained in one solution.

The fluctuation of the oxidation-reduction potential is not caused by deterioration (oxidizing degradation) of CD-3, but generated even if the required CD-3 concentration exists.

Employing the foregoing prior art, these problems cannot be overcome. In cases when the fluctuation of the development processing level is generated over a long term storage, adjustment of the setting condition of an automated processing apparatus for development processing is mandatory, resulting in increased frequency of adjusting operations.

Specifically, in recent year the required quality of processing solution stability has become problematic due to low replenishing rate, rapid processing and enhanced processing capability for digital exposures of the processing solution. On the other hand, the processing volume per shop is decreasing because of an increase in the number of minilab shops. Therefore, the storage period of the chemicals tends to be excessively long from the production to usage.

For this reason, it is required to promptly provide the technology to overcome these problems.

SUMMARY

Accordingly, an object of this invention is to provide a concentrated color developer composition exhibiting reduced variation in oxidation-reduction potential even after storage at relatively high temperature, thereby effectively inhibiting variation in gamma balance before and after storage, and a processing method by use thereof.

The foregoing problem can be solved by the following constitution:

1. A one-part photographic developing concentrate comprising:
   (i) a para(p-)phenylene diamine color developing agent; and
   (ii) a water-soluble organic solvent,
   wherein a molar ratio of sodium ion to potassium ion is at least 3, and a molar ratio of sulfate ion to carbonate ion is at least 0.25.
2. The one-part photographic developing concentrate of item 1, wherein the developing concentrate does not comprise any other cations than sodium ion.
3. The one-part photographic developing concentrate of item 1 or 2, wherein a compound represented by Formulas (A-I) to (A-IV) is further contained:

Formula (A-I)

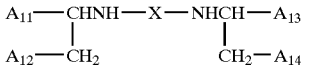

wherein $A_{11}$, $A_{12}$, $A_{13}$ and $A_{14}$, which may be the same or different, each represents —$CH_2OH$, —$PO_3(M_6)$ or —$COOM_7$; $M_6$ and $M_7$ each represents a hydrogen atom, an ammonium group, an alkaline metal atom or an organic ammonium group; X represents an alkylene group having 2 to 6 carbon atoms or —$(B_1O)_n$—$B_2$—; n represents an integer of 1 to 6; and $B_1$ and $B_2$, which may be the same or different, each represents an alkylene group having 1 to 5 carbon atoms.

Formula (A-II)

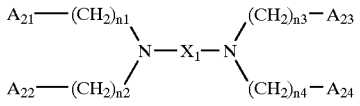

wherein $A_{21}$, $A_{22}$, $A_{23}$ and $A_{24}$, which may be the same or different, each represents —$CH_2OH$, —$COOM^1$ or —$PO_3(M^2)_2$; $M^1$ and $M^2$ each represents a hydrogen atom, an ammonium group, an alkaline metal or an organic ammonium group; $X_1$ represents a straight or branched alkylene group having 2 to 6 carbon atoms, a saturated or unsaturated organic group which forms a ring, or —$(B_{11}O)_{n5}$—$B_{12}$—; n5 represents an integer of 1–6; $B_{11}$ and $B_{12}$, which may be the same or different, each represents an alkylene group having 1–5 carbon atoms; and n1, n2, n3 and n4, which may be the same or different, each represents an integer of not less than 1 and at least one of n1, n2, n3 and n4 is 2 or more.

Formula (A-III)

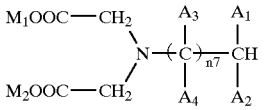

wherein $A_1$, $A_2$, $A_3$ and $A_4$, which may be the same or different, each represents a hydrogen atom, a hydroxyl group, —$COOM_3$, —$PO_3(M_4)_2$, —$CH_2COOM_5$, —$CH_2OH$ or a lower alkyl group, however, at least one of $A_1$ to $A_4$ represents —$COOM_3$, —$PO_3(M_4)_2$, or —$COOM_5$; $M_1$, $M_2$, $M_3$, $M_4$, and $M_5$ each represents a hydrogen atom, an ammonium group, an alkaline metal atom or an organic ammonium group; and n7 represents an integer of 0 to 2.

Formula (A-IV)

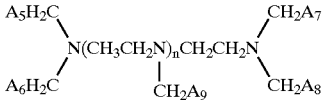

wherein, $A_5$, $A_6$, $A_7$, $A_8$ and $A_9$, which may be the same or different, each represents —$COOM_3$ or —$PO_3M_4M_5$; $M_3$, $M_4$ and $M_5$, which may be the same or different, each represents a hydrogen atom or an alkaline metal atom; and n represents an integer of 1 or 2.

4. The one-part photographic developing concentrate of any one of items 1 to 3, wherein the developing concentrate does not substantially comprise a fluorescent whitening agent.
5. A method for processing a silver halide color photographic material, comprising the steps of:
   imagewise irradiating the photographic material;
   developing the irradiated photographic material in a developing solution which is prepared by diluting a volume of the developing concentrate of any one of items 1 to 4 with water having a volume of at least 3 times of the volume of the developing concentrate; and then
   desilvering the developed photographic material.
6. The method for processing a silver halide color photographic material of item 5, wherein the developing solution is prepared by diluting the developing concentrate which does not comprise any other cations than sodium ion.
7. The method for processing a silver halide color photographic material of item 5 or 6, wherein the developing solution is prepared by diluting the developing concentrate of item 3.
8. The method for processing a silver halide color photographic material of any one of item 5 to 7, wherein the developing solution is prepared by diluting the developing concentrate of item 4.

A concentrated color developer composition in the form of a single component, prepared in accordance with the prior art exhibited marked variation in oxidation-reduction potential after storage, adversely affecting developability, specifically gamma balance, resulting in major practical problems. The above-described problem was overcome by the foregoing constitution according to this invention.

DESCRIPTION OF THE PREFERRED EMBODIMENTS

Figure 1:
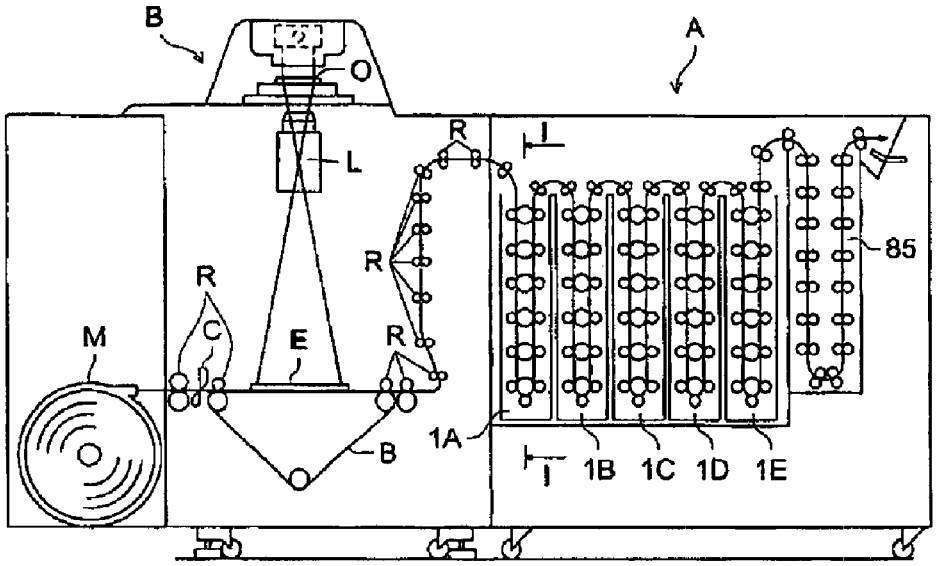
FIG. 1 represents a simplified block diagram of a printer-processor which was combined with an automated processing apparatus and a photographic printer.

The present invention will be detailed below. Specific examples of preferred p-phenylenediamine type color developing agents usable in the color developer composition of the present invention are shown below, but color developing agents usable in this invention are not limited to these examples.

Exemplified Compounds

1. N,N-diethyl-p-phenylenediamine
2. 2-amino-5-diethylaminotoluene
3. 2-amino-5-(N-ethyl-N-laurylamino)toluene
4. 4-(N-ethyl-N-(β-hydroxyethyl)amino)aniline
5. 2-methyl-4-(N-ethyl-N-(β-hydroxyethyl)amino)aniline
6. 4-amino-3-methyl-N-ethyl-N-(β-(methanesulfonamide)ethyl)aniline
7. N-(2-amino-5-diethylaminophenylethyl) methanesulfonamide
8. N,N-dimethyl-p-phenylenediamine
9. 4-amino-3-methyl-N-ethyl-N-methoxyethylaniline
10. 4-amino-3-methyl-N-ethyl-N-β-ethoxyethylaniline Of these p-phenylenediamine derivatives, specifically preferably used compounds in this invention are 4-amino-3-methyl-N-ethyl-N-(β-(methanesulfonamide)ethyl)aniline (exemplified compound 6) and 2-methyl-4-(N-ethyl-N-(β-hydroxyethyl)amino)aniline (exemplified compound 5).

Further, these p-phenyleneamine derivatives are used in the form of a sulfate, hydrochloride, sulfite or p-toluenesulfonate. Considering the concentrated composition, the added amount of p-phenylenediamine type color developing agents in this invention is preferably at least 0.08 mol/L, and more preferably at least 0.1 mol/L.

Examples of water soluble solvents suitable to the concentrated color developing composition of this invention include carboxylic acid amides and urea derivatives such as dimethylformamide, methylacetamide, dimethylacetamide, N,N'-dimethylurea, tetramethylurea, methanesulfonamide, dimethylethyleneurea, N-acetylglycine, N-valeramide, isovaleramide, N-butylamide, N,N-dimethylbutylamide, N-(2-hydroxyphenyl)acetamide, N-(2-methoxyphenyl) acetamide, 2-pyrrolidinone, ϵ-caplolactam, acetanilide, benzamide, toluenesulfonamide, and phthalimide; aliphatic and cyclic alcohols such as isopropanol, tert.-butyl alcohol, cyclohexanol, cyclohexane methanol, and 1,4-cyclohexane dimethanol; aliphatic and cyclic polyalcohols such as glycols, poluglycols, polywaxes, trimethyl-1,6-hexanediol, glycerol, 1,1,1-trimethylolpropane, pentaerythrite, and sorbitol; aliphatic and cyclic ketones such as acetone, ethyl methyl ketone, diethyl ketone, tert.-butyl methyl ketone, diisobutyl ketone, acetylacetone, acetonylacetone, cyclopentanone, ans acetophenol; aliphatic and cyclic carboxylates such as trimethoxymethane, methyl acetate, aryl acetate, ethylene acetate glycol monomethyl ether, ethylene glycol diacetate, 1-glycerol acetate, glycerol acetate, methylcyclohexyl acetate, methyl salicylate, and phenyl salicylate; aliphatic and cyclic phosphonates such as dimethyl methylphosphonate, and diethyl allylphosphonate; aliphatic and cyclic oxyalcohols such as 4-hydroxy-4-methyl-2-pentanone, and salicylaldehyde; aliphatic and cyclic aldehydes such as acetaldehyde, propanal, trimethylacetaldehyde, crotonaldehyde, glutaraldehyde, 1,2,5,6-tetrahydrobenzaldehyde, benzaldehyde, benzenepropane, and terephthalaldehyde; aliphatic and cyclic oximes such as butanone oxime, and cyclohexanone oxime; aliphatic and cyclic amines (primary, secondary or tertiary), such as ethylamine, diethylamine, triethylamine, dipropylamine, pyrrolidine, morpholine, and 2-aminopyrimidine; aliphatic and cyclic polyamines (primary, secondary or tertiary), such as ethylenediamine, 1-amino-2-diethylaminoethane, methyl-bis(2-methylaminoethyl)-amine, permethyldiethylenetriamine, 1,4-cyclohexanediamine, and 1,4-benzenediamine; aliphatic and cyclic hydroxyamines such as ethanolamine, 2-methylethylamine, 2-methylaminoethanol, 2-(dimethylamino)ethanol, 2-(2-dimethylaminoethoxy)-ethanol, diethanolamine, N-methyldiethanolamine, triethanolamine, 2-(2-aminoethylamino)ethanol, triisopropanolamine, 2-amino-2-hydroxymethyl-1,3-propanediol, 3-propanediol, 1-piperidineethanol, 2-aminophenol, barbituric acid, 2-(4-aminophenoxy)-ethanol, and 5-amino-1-naphthol.

With regard to the constitution of the concentrated color developing composition for a silver halide color photographic sensitized material of this invention, the molar ratio of (Na ions)/(K ions) used therein is necessarily larger than 3. In cases when K ions exceed Na ions, stability of the color developing agent in the solution deteriorates, resulting in an increased tendency to generate fluctuation of the oxidation-reduction potential.

In the present invention, it has been confirmed that stability is enhanced by adjusting the ratio of Na ions/K ions within the foregoing range. A more preferable range is obtained in the system which uses no K ions (all of the cations being Na ions, that is, Na ions are 100%). The ratio of Na ions/K ions is necessarily in the foregoing range, however, other cations may exist.

With regard to the constitution of the concentrated color developing composition for a silver halide color photographic sensitized material of this invention, the molar ratio of carbonate ions/sulfates ion used therein is necessarily more than 0.25. Generally, as knowledge regarding stability of a concentrated color developing composition, one about variation of cations is well known. However, the inventors of this invention have repeated experiments about an anion ratio to find a balance to enhance the foregoing storage stability.

The more preferable range of the molar ratio of carbonate ions/sulfate ions used in the invention is at least 0.30.

The compounds represented by Formulas (A-I) through (A-IV), which are used in the concentrated color developing composition of this invention, will now be described. Initially, the compounds represented by Formula (A-I) will be described.

In the Formula, $A_{11}$–$A_{14}$, which may be the same or different, each represents —$CH_2OH$, —$PO_3(M_6)_2$ or —$COOM_7$. $M_6$ and $M_7$ each represents a hydrogen atom, an ammonium group, an alkaline metal atom (such as a sodium and potassium), or an organic ammonium group (such as a methylammonium group and a trimethylammonium group). X represents an alkylene group having 2–6 carbon atoms, which may be substituted, or —$(B_1O)n$—$B_2$—. Further, $B_1$ and $B_2$, which may be the same or different, each represents an alkylene group having 1–5 carbon atoms, which may be substituted. Examples of alkylene groups represented by X include ethylene, trimethylene and tetramethylene. Further, examples of alkylene group represented by $B_1$ and $B_2$ include methylene, ethylene and trimethylene. Examples of substituents of alkylene groups represented by X, $B_1$ or $B_2$ include a hydroxyl group, and an alkyl group having 1–3 carbon atoms (such as methyl group and ethyl group). "n" represents an integer of 1–6, and preferably 1–4.

Specific examples of preferred compounds represented by Formula (A-I) are shown below but compounds usable in the invention are not limited to these.

A-I-1

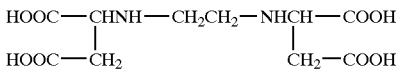

A-I-2

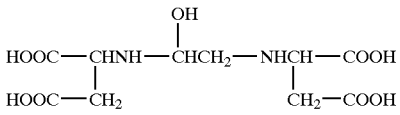

A-I-3

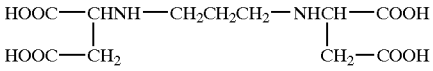

A-I-4

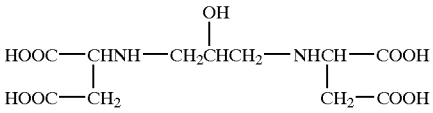

A-I-5

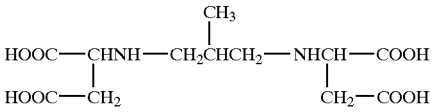

A-I-6

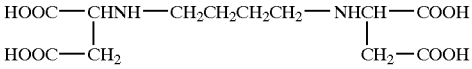

A-I-7

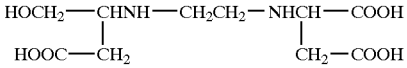

A-I-8

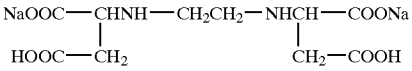

A-I-9

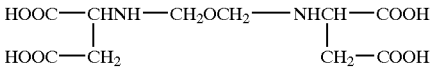

A-I-10

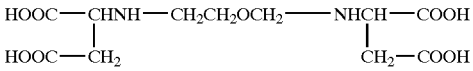

A-I-11

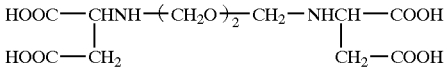

A-I-12

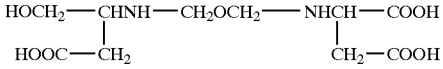

A-I-13

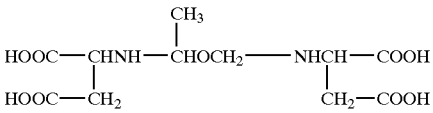

A-I-14

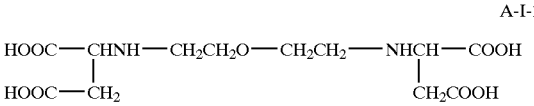

-continued

A-I-15

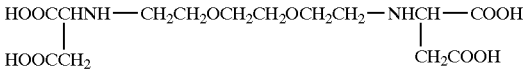

A-I-16

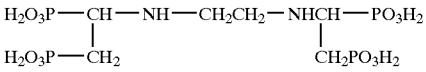

A-I-17

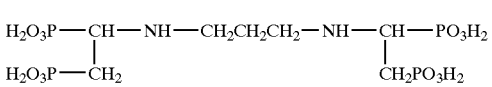

The compounds represented by foregoing Formula (A-I) can be synthesized based on commonly known methods.

Of these, specifically preferable compounds are (A-I-1), (A-I-3) and (A-I-14).

The compounds represented by Formula (A-II) will be described below.

In the Formula, $A_{21}$–$A_{24}$, which may be the same or different, each represents —$CH_2OH$, —$PO_3(M^2)_2$ or —$COOM^1$. $M^1$ and $M^2$ represent an hydrogen atom, an ammonium group, an alkaline metal atom (such as sodium and potassium), or an organic ammonium group (such as a methylammonium group and a trimethylammonium group).

$X_1$ represents a straight or branched chained alkylene group having 2–6 carbon atoms, a saturated or unsaturated organic group forming a ring, or —$(B_{11}O)n_5B_{12}$—. $B_{11}$ and $B_{12}$, which may be the same or different, each represents an alkylene group having 1–5 carbon atoms (including a substitution product). "$n_1$"–"$n_4$", which may be the same or different, represent an integer of more than 1, and at least one of them is to be more than 2. Specific examples of alkylene groups represented by $X_1$ include ethylene, trimethylene and tetramethylene. Specific examples of alkylene groups represented by $B_{11}$ and $B_{12}$ include methylene, ethylene and trimethylene. Examples of substituents of alkylene groups represented by $X_1$, $B_{11}$ and $B_{12}$ include a hydroxyl group, an alkyl group having 1–3 carbon atoms (such as a methyl group and an ethyl group). "$n_5$" represents an integer of 1–6, preferably 1–4, and more specifically preferably 1–2.

Specific examples of preferred compounds represented by Formula (A-II) are shown below, but compounds usable in this invention are not limited to these.

A-II-1

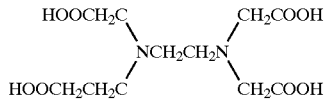

A-II-2

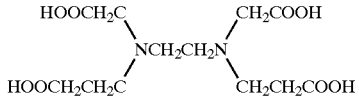

A-II-3

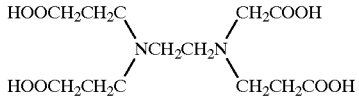

A-II-4

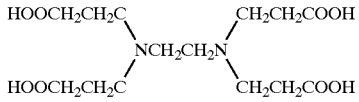

-continued
A-II-5
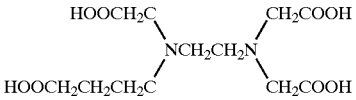
A-II-6
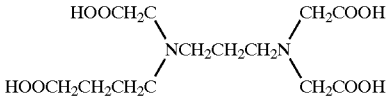
A-II-7
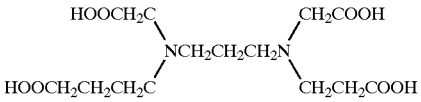
A-II-8
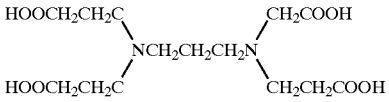
A-II-9
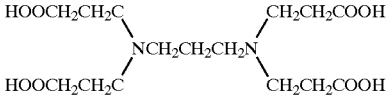
A-II-10
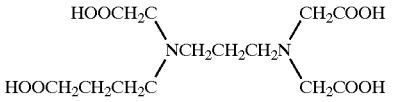
A-II-11
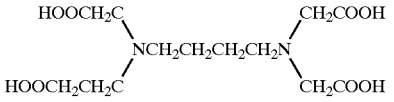
A-II-12
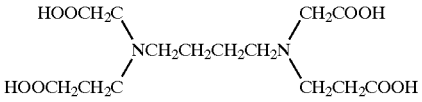
A-II-13
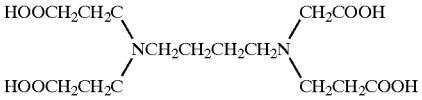
A-II-14
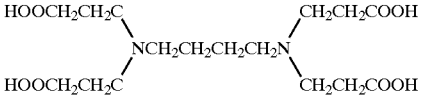
A-II-15
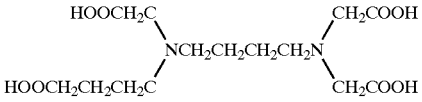
A-II-16
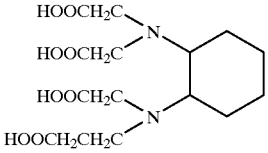
A-II-17
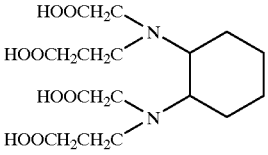
-continued
A-II-18
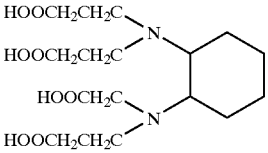
A-II-19
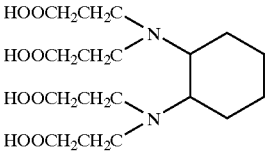
A-II-20
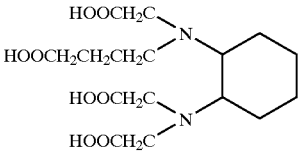
A-II-21
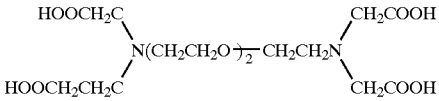
A-II-22
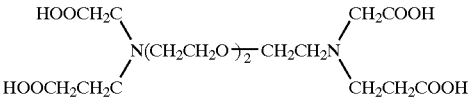
A-II-23
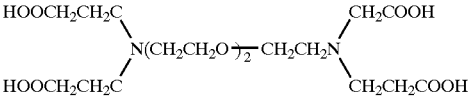
A-II-24
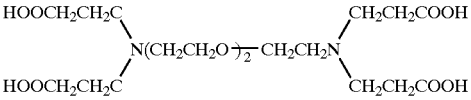
A-II-25
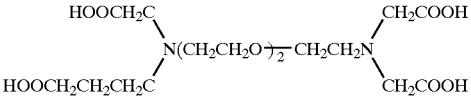
A-II-26
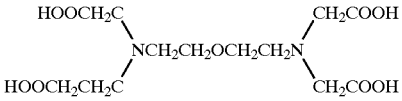
A-II-27
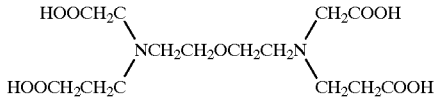
A-II-28
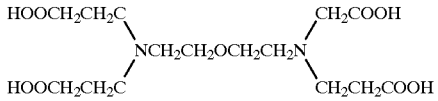
A-II-29
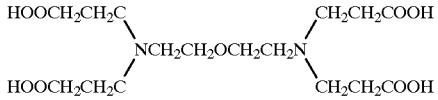
A-II-30
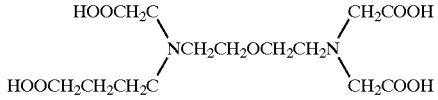

-continued

A-II-31

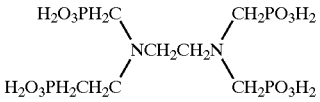

A-II-32

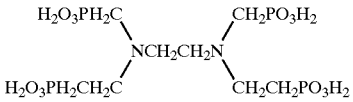

A-II-33

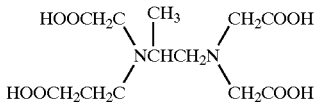

A-II-34

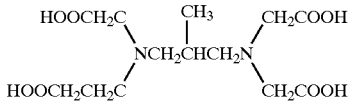

Foregoing (A-II-16), (A-II-17), (A-II-18), (A-II-19) and (A-II-20) include both cis isomers.

The compounds represented by foregoing Formula (A-II) can be synthesized based on commonly known methods.

Of specific examples, specifically preferred compounds are (A-II-1), (A-II-2) and (A-II-6).

The added amount of the compounds represented by foregoing (A-I) and (A-II) is preferably in the range of 0.001–0.1 mol/L, and more preferably in the range of 0.005–0.05, in cases when the component is used for a color developing replenisher as a solution diluted by a factor of 4.

Next, the compounds represented by foregoing Formula (A-III) will be described.

In Formula (A-III), $A_1$, $A_2$, $A_3$ and $A_4$, which may be the same or different, each represents an hydrogen atom, an hydroxyl group, —$COOM_3$, —$PO_3(M_4)_2$, —$CH_2COOM_5$, —$CH_2OH$ and a lower alkyl group (methyl group, ethyl group, isopropyl group and n-propyl group). However, at least one of $A_1$, $A_2$, $A_3$ and $A_4$ represents —$COOM_3$, —$PO_3(M_4)_2$ or —$CH_2COOM_5$. $M_1$, $M_2$, $M_3$, $M_4$ and $M_5$ each represents an hydrogen atom, a sodium atom, a potassium atom, a lithium atom, an ammonium atom, an alkaline metal atom, or an organic ammonium group, and preferably a hydrogen atom, a sodium atom, or a potassium atom. "$n_7$" represents an integer of 0–2.

Specific examples of preferred compounds represented by Formula (A-III) are shown below.

A-III-1

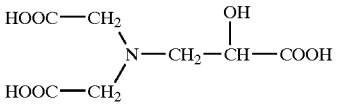

A-III-2

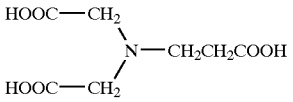

A-III-3

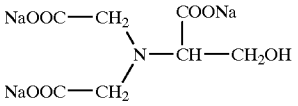

-continued

A-III-4

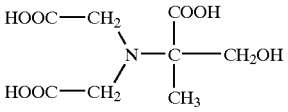

A-III-5

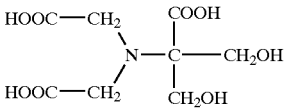

A-III-6

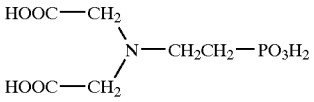

A-III-7

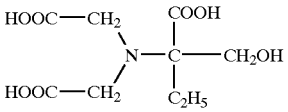

A-III-8

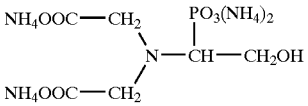

A-III-9

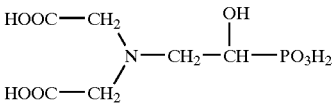

A-III-10

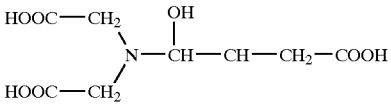

A-III-11

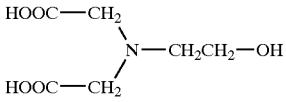

A-III-12

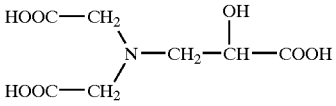

A-III-13

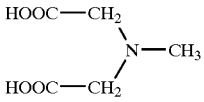

The compounds represented by foregoing Formula (A-III) can be synthesized in employing commonly known methods, such as described in JP-A 63-267750, 63-267751, 2-115172 and 2-295954 (hereinafter the term JP-A refers to unexamined Japanese Patent Application Publication).

In cases when the concentrated color developer composition of the invention is diluted at least 4 times as a color developer replenisher, the content of the compound represented by formula (A-III) is preferably 0.001 to 0.1 mol/L, and more preferably 0.005 to 0.05 mol/L.

Specific examples of the compound represented by formula (A-IV) include diethylenetriaminepentaacetic acid, triethylenetetraminehexaacetic cid, diethylenetriaminepentamethylenephosphonic acid and triethylenetetraminehexamethylenephosphonic acid, and their salts (e.g., alkali metal salts such as potassium, sodium and lithium). These compounds are also commercially available.

Of these compounds represented by Formula (A-IV), diethylenetriaminepentaacetic acid and its salt are specifically preferably employed to achieve the object of this invention.

The processing chemical component of this invention may contain a small amount of sulfite ions or may substantially not contain any, depending on the kind of the targeted photographic materials. On the other hand, since, sulfite ions exhibit significant preserving action, on the other hand, they may undesirably affect photographic characteristics during color development processing depending on the targeted photographic materials. In this invention, it is preferred to add a hydroxylamine derivative or its salt. The preferred hydroxylamine derivatives are alkylhydroxylamines which have 1–8 alkyl groups having 2–4 carbon atoms and alkylhydroxylamines which have 1–2 alkyl groups having 2–4 carbon atoms and substituted by a carboxyl group, a sulfo group, a phosphono group, or a hydroxyl group. Employing these compounds makes it possible to further enhance storage stability, resulting in an expanded tolerance of air transmission rate of a container. Consequently, the tolerance level is increased by reducing thickness of the container wall or enlarging the specific surface. Further, in addition to the foregoing hydroxylamine derivatives, added may be the hydroxylamines described in JP-A 1-97953, 1-186939, 1-186940 and 1-187557.

The concentrated color developer composition of this invention may contain an inorganic preserving agent or an organic preserving agent, in addition to the foregoing sulfite ions and hydroxylamine derivatives. An organic preserving agent indicates all of the organic compounds which decrease the deterioration rate of aromatic primary amine color developing agents by incorporating them into the processing solution for photographic materials, that is, those are the organic compounds which have a function to prevent the air oxidation of the color developing agents. Of these, specifically effective preserving agents are hydroxylamine derivatives besides the foregoing ones, hydroxamic acids, hydrazides, phenols, α-hydroxy ketones, α-amino ketones, saccarides, monoamines, diamines, polyamines, quaternary ammonium salts, nitroxy radicals, alcohols, oximes, diamido compounds and condensed ring amines. These are disclosed in publications and specifications such as JP-A 63-4235, 63-30845, 63-21647, 63-44655, 63-53551, 63-43140, 63-56654, 63-58346, 63-43138, 63-146041, 63-44657, 63-44656, U.S. Pat. Nos. 3,615,503, 2,494,903, JP-A 52-143020 and JP-B 48-30496 (hereinafter, the term JP-B refers to examined Japanese Patent Publication).

pH of the concentrated color developer composition of this invention is controlled to provide a higher pH to contain the color developing agent at a higher concentration, usually being in the range of 11.0–13.5, preferably 12.0–13.5, and more preferably 12.5–13.5. The color developing solution and color developing replenisher are preferably used at a pH of more than 9.5, and more preferably in the range of 10.0–12.5. To maintain a stable pH, it is preferable to employ various buffer agents. Examples thereof include carbonates, phosphates, borates, tetraborates, hydroxybenzoates, glycylates, N,N-dimethylglycinates, leucinates, norleucinates, guaninates, 3,4-dihydroxyphenylalaninates, alaninates, aminobutylates, 2-amino-2-methyl-1,3-propanediolates, valinates, prolinates, trishydroxyaminomathanates, and lysinates. Specifically, carbonates, phosphates, tetraborates and hydrxybenzoates superior are in a buffer capacity at a high pH, at more than 9.0, exhibit no undesirable affects (such as fogging) to the photographic characteristics by adding to the color developing solution, and further exhibit the advantage of a lower cost. It is preferred to use these buffer agents to conform to the specific gravity limits of this invention.

Specific examples of these buffer agents include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, o-sodium hydroxybenzoate (sodium salicylate), o-potassium hydroxybenzoate, 5-sulfo-2-sodium hydroxybenzoate (5-potassium sulfosalicylate), and 5-sulfo-2-hydroxybenzoate (5-potassium sulfosalicylate). However, the present invention is not limited to these compounds. The specifically preferable buffer agent is potassium carbonate because of the advantageous point of the possibility of an effective increase of specific gravity without deposition due to high solubility. The amount of buffer agents is added to the composition so that the concentration in the diluted and prepared color developing replenisher is at least 0.01 mol/L, and specifically 0.1–0.5 mol/L.

Generally, known is to use stilbene type fluorescent brightening agents with the concentrated color developer composition. However, as a preferable embodiment of this invention, it is preferred that these fluorescent brightening agents are substantially not added. The addition of the fluorescent brightening agents is effective to maintain the low density of the unexposed portion, which is a silver halide photographic sensitized material for direct observation, however, it is not preferable from the point of view of stability in the concentrated composition. Specifically, the effect of fluctuation of oxidation-reduction potential is confirmed in storage of a relatively long term at a high temperature condition while coexistence with a color developing agent.

In addition to the foregoing, hydroxides of alkaline metals may be contained, from a pH adjustment point of view.

The concentrated color developer composition of this invention has practicability such that it provides color development to an image exposed photographic material comprising on a support at least one silver halide emulsion layer containing imagewise distributed developable silver halide grains. Various photographic elements containing various types of emulsions (e.g., color negative film, color reversal film, color movie film and print paper) can be processed using the concentrated color developer composition of this invention. Such emulsions are commonly known in the photographic art (as described in Research Disclosures).

Color development of an image exposed photographic material is carried out by bringing the photographic material into contact with color developing solution prepared according to this invention in an appropriate processing apparatus under optimal time and temperature conditions, obtaining desired developed images. Thereafter, additional processing can be conducted in the specific order known in the art employing at least one of the conventional processing steps such as a development stop step, a bleaching step, a fixing step, a bleach/fixing step, a washing (or rinsing) step, a stabilizing step and a drying step (but not limited to these). Commonly known are useful processing steps of various processing protocols including process C-41 for color negative film, process RA-4 for color paper and process E-6 for color reversal film, and other useful conditions and material thereof.

The processing time and temperature in each of the respective processing steps are known in the art. For example, color development is generally carried out at a temperature of 20–60° C., while the preferable time of color development is 15–250 sec. The concentrated color developer composition of this invention is appropriately diluted at least by a factor of 4 and at most a factor of 12 to prepare a working solution or a replenishing solution. The dilution rate is preferably a factor of 4–10, and water is preferably used as a diluent. Dilution may be conducted before or during processing.

EXAMPLES

Examples of this invention will be described below, but the embodiments of this invention are not limited to these examples.

Example 1

| Concentrated Color Developer Composition | |
|---|---|
| Color developing agent (CD-3) | the amount described in Table 1 |
| Potassium sulfite | 2 g |
| Diethylhydroxylamine | 25 g |
| Stilbene type fluorescent whitening agent | 6 g |
| EDTA.4H | 0.04 mol |
| Diethylene glycol | 100 g |
| Potassium/sodium carbonate | 0.80 mol |
| Potassium/sodium sulfate | the amount described in Table 1 |

In the above composition, the ratios of sodium/potassium and sulfate/carbonate were adjusted to the amounts described in Table 1.

pH was adjusted to 12.5 with KOH and NaOH, after which water was added to a total volume of 1,000 ml.

Stilbene type fluorescent brightening agent was employed, as described below.

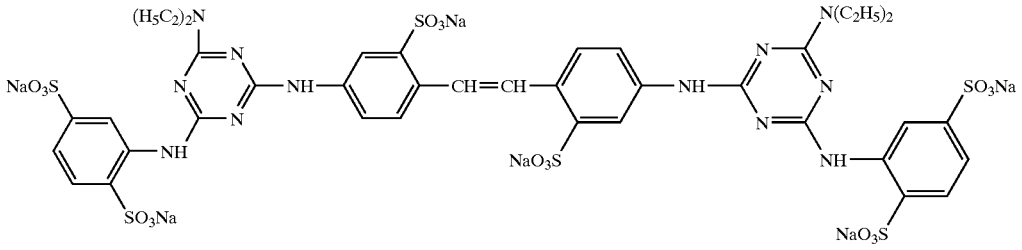

This concentrated color developer composition was placed in a sealed container and stored in an incubator for 4 months at 50° C. The foregoing concentrated color developer compositions before and after storage were diluted by a factor of 8 times, and the following additives were added to prepare color developing working solutions.

| Additives | |
|---|---|
| Potassium chloride | 5.0 g/L |
| Potassium carbonate | 4.0 g/L |
| Potassium bicarbonate | 8.0 g/L |
| pH | 10.15 |

The pH was adjusted employing 50% sulfuric acid or potassium hydroxide.

The thus prepared working solutions were each measured with respect to oxidation-reduction potential or redox potential (also denoted as E), using HM-30S (available from TOA Electronics Ltd.) to determine the difference in E before and after storage (ΔE=E before storage minus E after storage). Variation of oxidation-reduction potential was determined using the following equation. The less variation of oxidation-reduction potential indicates that a kit is superior in storage stability.

Oxidation-reduction potential variation (ΔE %)=(potential after storage/potential before storage−1)×100. Further, development was conducted under the following conditions, in which photographic material exposed through an optical wedge (Konica Color QA Paper) was used to determine gamma balance as defined below. Low variation of gamma balance indicates low variation in processing level after storage and superior storage stability.

Gamma of each color density=Exposure amount corresponding to density 1.8 minus exposure amount corresponding to density 0.8.

Gamma balance=Red density gamma/Green density gamma

Gamma balance change rate (%)=(gamma balance after storage/gamma balance before storage−1)×100

Processing Condition

| Step | Processing Time | Processing Temperature |
|---|---|---|
| Color developing | 45 sec. | 37.5° C. |
| Bleach-fixing | 45 sec. | 37.0° C. |
| Stabilizing | 30 sec. × 3 tanks | 37.0° C. |
| Drying | 60 sec. | 65° C. |

The bleach-fixing solution was prepared with a usual dissolution method using Bleach-fix Replenisher for Konica Color QA Paper K-20P2R-03 (a product of Konica Corp.).

The stabilizing solution was prepared with a usual dissolving method using Super Stabilizer Replenisher for Konica Color QA Paper K-P3R-01 (produced by Konica Corp.).

TABLE 1

| No. | Na:K Molar ratio | CD-3 Amount (mol) | $K_2SO_4$ Amount (mol) | $SO_4/CO_3$ Molar ratio | Effect: ΔE variation | Effect: Gamma balance change rate (%) | Remarks |
|---|---|---|---|---|---|---|---|
| 1 | 4:1 | 0.092 | 0 | 0.17 | 11.1 | 15.4 | Comp. |
| 2 | 4:1 | 0.092 | 0.03 | 0.20 | 10.9 | 14.9 | Comp. |
| 3 | 4:1 | 0.092 | 0.06 | 0.23 | 10.8 | 14.7 | Comp. |
| 4 | 4:1 | 0.092 | 0.08 | 0.25 | 8.8 | 8.9 | Inv. |
| 5 | 4:1 | 0.092 | 0.13 | 0.30 | 8.5 | 9.1 | Inv. |
| 6 | 4:1 | 0.092 | 0.33 | 0.80 | 9.0 | 8.4 | Inv. |
| 7 | 4:1 | 0.092 | 0.83 | 1.00 | 9.2 | 9.8 | Inv. |
| 8 | 1:1 | 0.092 | 0.13 | 0.30 | 12.4 | 16.1 | Comp. |
| 9 | 2:1 | 0.092 | 0.13 | 0.30 | 13.1 | 16.0 | Comp. |
| 10 | 3:1 | 0.092 | 0.13 | 0.30 | 9.6 | 9.7 | Inv. |
| 11 | 5:1 | 0.092 | 0.13 | 0.30 | 8.4 | 9.0 | Inv. |
| 12 | 10:1 | 0.092 | 0.13 | 0.30 | 8.1 | 8.9 | Inv. |
| 13 | 100:0 | 0.092 | 0.13 | 0.30 | 7.3 | 7.4 | Inv. |
| 14 | 4:1 | 0.138 | 0 | 0.26 | 8.5 | 8.9 | Inv. |

Comp.: Comparative example
Inv.: Present invention

As is apparent from Table 1, it was proved that the combination according to the invention provided a concentrated color developer composition exhibiting reduced variation in oxidation-reduction potential before and after storage at a relatively high temperature and reduced variation in gamma balance, leading to superior storage stability. Generally, a variation in gamma balance of more than 10% results in a change in print density, producing problems in practical use.

It was further proved that a molar ratio of Na:k was required for at least 3:1, more preferably at least 4:1, and still more preferably Na salt was 100%.

It was also proved that the molar ratio of SO4:CO3 was preferably required to be least 0.25, and more preferably in the range from a low of 0.30 to a high of 1.0.

Example 2

Experiments were carried out similarly to Example 1, except that EDTA.4H added to the concentrated color developer composition in experiment No. 5 in Example 1 was changed to the compounds to be equimolar as shown in Table 2. Results thereof are shown in Table 2.

TABLE 2

| No. | Additive | Effect: ΔE variation (%) | Effect: Gamma balance change rate (%) | Remarks |
|---|---|---|---|---|
| 2-1 | None | 8.9 | 9.4 | Inv. |
| 2-2 | HEDP | 9.0 | 9.2 | Inv. |
| 2-3 | Hexameta-phosphoric acid | 8.8 | 9.4 | Inv. |
| 2-4 | Citric acid | 9.3 | 9.7 | Inv. |
| 2-5 | A-I-1 | 6.2 | 6.9 | Inv. |
| 2-6 | A-I-3 | 6.5 | 7.2 | Inv. |
| 2-7 | A-I-14 | 6.8 | 7.5 | Inv. |
| 2-8 | A-II-1 | 7.1 | 7.8 | Inv. |
| 2-9 | A-II-2 | 7.3 | 7.7 | Inv. |
| 2-10 | A-III-1 | 7.4 | 7.5 | Inv. |
| 2-11 | A-III-2 | 7.8 | 7.3 | Inv. |
| 2-12 | A-III-13 | 7.9 | 7.9 | Inv. |

TABLE 2-continued

| No. | Additive | Effect: ΔE variation (%) | Effect: Gamma balance change rate (%) | Remarks |
|---|---|---|---|---|
| 2-13 | DTPA | 6.0 | 6.2 | Inv. |
| 2-14 | TTHA | 6.3 | 6.5 | Inv. |

Inv.: Present invention
HEDP = hydroxyethylidene disulfonic acid
DTPA = diethylenetriamine pentaacetic acid
TTHA = triethylenetetramine hexaacetic acid As is apparent from the results of Table 2, it is preferred to add the compounds represented by Formulas (A-I)–(A-IV) to obtain further enhanced results of this invention.

Example 3

Experiments were carried out similarly to Example 1, except that the stilbene type fluorescent brightening agent added to the concentrated color developer composition in experiment No. 5 in Example 1 was changed to the compounds to be equimolar as shown in Table 3. Results thereof are shown in Table 3.

TABLE 3

| No. | Additive | Effect: ΔE variation (%) | Effect: Gamma balance change rate (%) | Remarks |
|---|---|---|---|---|
| 3-1 | Compound A | 8.9 | 9.6 | Inv. |
| 3-2 | Compound B | 9.4 | 9.7 | Inv. |
| 3-3 | Compound C | 8.8 | 9.5 | Inv. |
| 3-4 | Compound D | 8.3 | 9.1 | Inv. |
| 3-5 | Compound E | 9.2 | 9.9 | Inv. |
| 3-6 | None | 6.1 | 7.0 | Inv. |

Inv.: Present invention

TABLE 3-continued

| No. | Additive | Effect: ΔE variation (%) | Effect: Gamma balance change rate (%) | Remarks |
|---|---|---|---|---|
| | Compound A 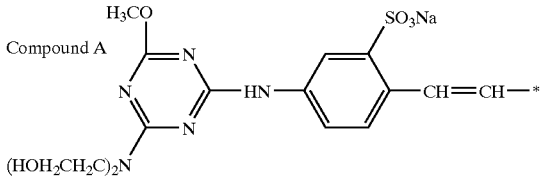 | | | |
| | 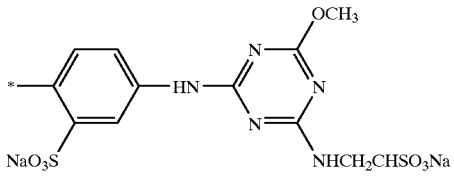 | | | |
| | Compound B 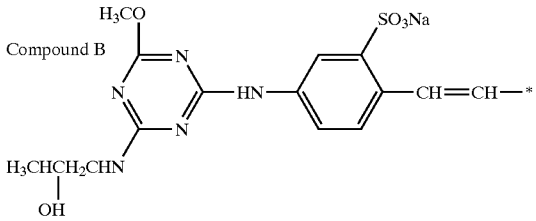 | | | |
| | 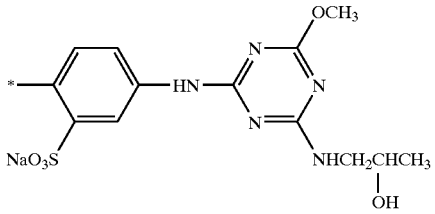 | | | |
| | Compound C 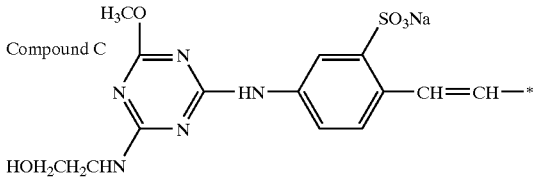 | | | |
| | 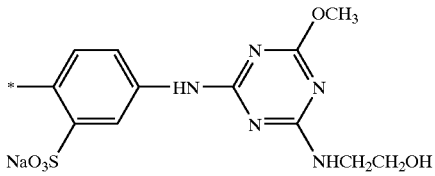 | | | |
| | Compound D 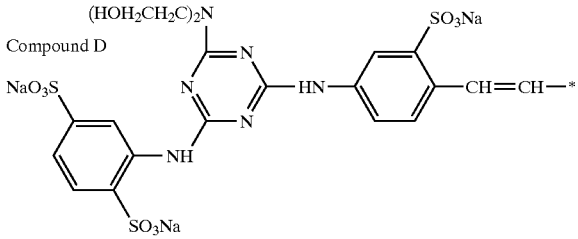 | | | |
| | 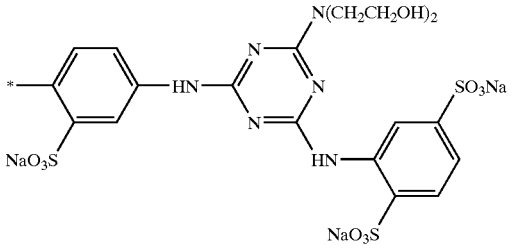 | | | |
| | Compound E 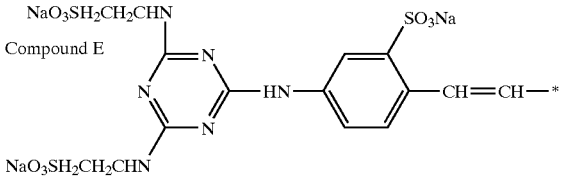 | | | |
| | 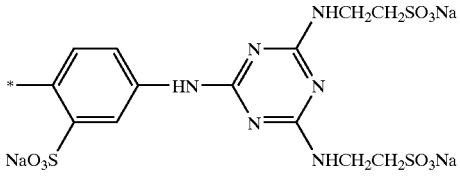 | | | |

As is apparent from the results of Table 3, it was preferable that a fluorescent brightening agent did not need to be added to obtain further enhanced results of this invention.

Example 4

Experiments were carried out similarly to Example 2, except that the stilbene type fluorescent brightening agent added to the concentrated color developer composition in experiment No. 13 in Example 2 was eliminated. Obtained were favorable results in which ΔE variation was 5.8% and gamma balance change rate was 6.0%.

Example 5

Using the automatic processor like the one shown in FIG. 1, processing was conducted according to the conditions described below. The processing amount was 2,000 sheets of L-size prints (89 mm×127 mm) per day using Konica Color QA Paper until the replenished volume of the color developing solution reached 3 times the processing tank volume.

FIG. 1 is a schematic view of a printer-processor which was combined with automated processing apparatus A and photographic printer B.

In FIG. 1, at the lower left section of Photographic printer B, magazine M is provided which contains rolled up photographic printing paper of an unexposed photographic material. The printing paper drawn out from the magazine is cut into the predefined size through the feeding rollers and a cutter section, resulting in a sheet paper. This sheet paper is transferred with a belt transfer means, and images of original images O are exposed on this paper. The exposed paper sheet is further transferred with plural paired transfer rollers to feed them into automated processing apparatus A. In automated processing apparatus A, the paper sheet is processed with each of a color developing process, a bleach-fixing process, a stabilizing process, with sequential transportation with a roller transport means through the processing tanks of each color developing tank 1A, bleach-fixing tank 1B, stabilizing tanks 1C, 1D, 1E (substantially a triple tank configuration). The paper sheet processed with each of the foregoing processes is dried in drying section 35, and discharged from the processing apparatus.

In addition, a single-dotted line indicates the transport route of the photographic sensitized material. Further, in the example of this invention, sensitized material is fed into the apparatus in the form of a cut sheet, but the material may be fed into the apparatus in the form of a continuous sheet from a roll.

TABLE 4

Processing Steps and Conditions

| Step | Time (seconds) | Temperature (° C.) | Replenishing Rate (ml/m²) | Tank Volume (L) |
|---|---|---|---|---|
| Color developing | 45 | 37.5 | 65 | 16.1 |
| Bleach-fixing | 45 | 37.0 | 54 | 15.7 |
| Stabilizing·1 | 30 | 37.0 | Cascade flow | 14.3 |
| Stabilizing·2 | 30 | 37.0 | method of 3-2-1 | 14.5 |
| Stabilizing·3 | 30 | 37.0 | 248 | 15.1 |
| Drying | 60 | 65.0 | | |

Color Developing Replenisher

Experiment No. 5 solution of Example 1 stored in an incubator for 3 months at 50° C. was diluted with water by a factor of 4 to prepare the Color Developing Replenisher. A working solution of color developing solution, a bleach-fixing solution and a stabilizing solution were prepared as follows.

| Color Developer Working Solution | |
|---|---|
| Color developing agent (CD-3) | 4.0 g |
| Potassium sulfite | 0.1 g |
| Diethylhydroxylamine | 2.5 g |
| Stilbene type fluorescent brightening agent | 0.5 g |
| EDTA.4H | 2.5 g |
| Diethylene glycol | 25 g |
| Sodium carbonate | 20 g |
| Potassium chloride | 5.0 g |
| pH | 10.15 |

The pH was adjusted using 50% sulfuric acid and KOH.

Bleach-Fixing Solution

Replenisher

K-22P2R-01.L, a Konica Corp. product, was used after being dissolved using a common method.

Working Solution

A solution of the foregoing replenisher at 11.2 L was used with 5.8 L of added water.

Stabilizing Solution

Replenisher=Working Solution

K-P3R-01, a Konica Corp. product, was used after being dissolved using a common method.

Variation in oxidation-reduction potential of the developer working solution and variation in gamma balance with the developers before and after storage were measured, being 5.6% and 6.7% respectively, whereby, superior results were obtained.

According to the present invention, it is possible to provide a concentrated color developer composition of a single component configuration which can reduce variation in oxidation-reduction potential in storage at a relatively high temperature, resulting in reduced processing fluctuation of gamma balance variation before and after storage, and a processing method by using thereof.

What is claimed is:

1. A one-part photographic developing concentrate comprising:

(i) a paraphenylene diamine color developing agent;

(ii) a water-soluble organic solvent; and (iii) sodium ions, potassium ions, sulfate ions and carbonate ions, wherein a molar ratio of sodium ion to potassium ion is at least 3, and a molar ratio of sulfate ion to carbonate ion is at least 0.25.

2. The one-part photographic developing concentrate of claim 1, wherein a compound represented by Formulas (A-I) to (A-IV) is further contained:

Formula (A-I)

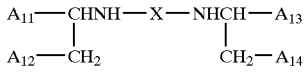

wherein $A_{11}$, $A_{12}$, $A_{13}$ and $A_{14}$, which may be the same or different, each represents —$CH_2OH$, —$PO_3(M_6)$ or —$COOM_7$; $M_6$ and $M_7$ each represents a hydrogen atom, an ammonium group, an alkaline metal atom or an organic ammonium group; X represents an alkylene group having 2 to 6 carbon atoms or —$(B\text{-}_1O)_n$—$B_2$—; n represents an integer of 1 to 6; and $B_1$ and $B_2$, which may be the same or different, each represents an alkylene group having 1 to 5 carbon atoms, Formula (A-II)

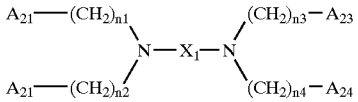

wherein $A_{21}$, $A_{22}$, $A_{23}$ and $A_{24}$, which may be the same or different, each represents —$CH_2OH$, —$COOM^1$ or —$PO_3(M^2)_2$; $M^1$ and $M^2$ each represents a hydrogen atom, an ammonium group, an alkaline metal or an organic ammonium group; $X_1$ represents a straight or branched alkylene group having 2 to 6 carbon atoms, a saturated or unsaturated organic group which forms a ring, or —$(B_{11}O)_{n5}$—$B_{12}$—; n5 represents an integer of 1–6; $B_{11}$ and $B_{12}$, which may be the same or different, each represents an alkylene group having 1–5 carbon atoms; and n1, n2, n3 and n4, which may be the same or different, each represents an integer of not less than 1 and at least one of n1, n2, n3 and n4 is 2 or more, Formula (A-III)

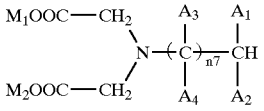

wherein $A_1$, $A_2$, $A_3$ and $A_4$, which may be the same or different, each represents a hydrogen atom, a hydroxyl group, —$COOM_3$, —$PO_3(M_4)_2$, —$CH_2COOM_5$, —$CH_2OH$ or a lower alkyl group, however, at least one of $A_1$ to $A_4$ represents —$COOM_3$, —$PO_3(M_4)_2$, or —$COOM_5$; $M_1$, $M_2$, $M_3$, $M_4$, and $M_5$ each represents a hydrogen atom, an ammonium group, an alkaline metal atom or an organic ammonium group; and n7 represents an integer of 0 to 2, Formula (A-IV)

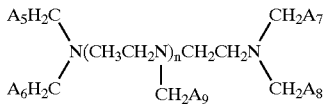

wherein, $A_5$, $A_6$, $A_7$, $A_8$ and $A_9$, which may be the same or different, each represents —$COOM_3$ or —$PO_3M_4M_5$; $M_3$, $M_4$ and M5, which may be the same or different, each represents a hydrogen atom or an alkaline metal atom; and n represents an integer of 1 or 2.

3. The one-part photographic developing concentrate of claim 1, wherein the developing concentrate does not comprise a fluorescent whitening agent.

4. A one-part photographic developing concentrate comprising:

(i) a paraphenylene diamine color developing agent; and (ii) a water-soluble organic solvent, wherein a molar ratio of sodium ion to potassium ion is at least 3, and a molar ratio of sulfate ion to carbonate ion is at least 0.25; and wherein a compound represented by formulas (A-I) to (A-IV) is further contained:

Formula (A-I)

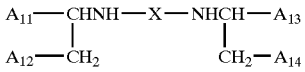

wherein $A_{11}$, $A_{12}$, $A_{13}$ and $A_{14}$, which may be the same or different , each represents —$CH_2OH$, —$PO_3(M_6)$ or —$COOM_7$; $M_6$ and $M_7$ each represents a hydrogen atom, an ammonium group, an alkaline metal atom or an organic ammonium group; X represents an alkylene group having 2 to 6 carbon atoms or —$(B_1O)_n$—$B_2$—; n represents an integer of 1 to 6; and $B_1$ and $B_2$, which may be the same or different , each represents an alkylene group having 1 to 5 carbon atoms, Formula (A-II)

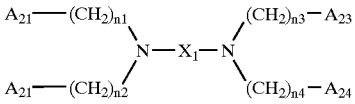

wherein $A_{21}$, $A_{22}$, $A_{23}$ and $A_{24}$, which may be the same or different, each represents —$CH_2OH$, —$COOM^1$ or —$PO_3(M^2)_2$; $M^1$ and $M^2$ each represents a hydrogen atom, an ammonium group, an alkaline metal or an organic ammonium group; $X_1$ represents a straight or branched alkylene group having 2 to 6 carbon atoms, a saturated or unsaturated organic group which forms a ring, or —$(B_{11}O)_{n5}$—$B_{12}$—; n5 represents an integer of 1–6; $B_{11}$ and $B_{12}$, which may be the same or different, each represents an alkylene group having 1–5 carbon atoms; and n1, n2, n3 and n4, which may be the same or different, each represents an integer of not less than 1 and at least one of n1, n2, n3 and n4 is 2 or more, Formula (A-III)

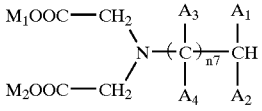

wherein $A_1$, $A_2$, $A_3$ and $A_4$, which may be the same or different, each represents a hydrogen atom, a hydroxyl group, —$COOM_3$, —$PO_3(M_4)_2$, —$CH_2COOM_5$, —$CH_2OH$ or a lower alkyl group, however, at least one of $A_1$ to $A_4$ represents —$COOM_3$, —$PO_3(M_4)_2$, or —$COOM_5$; $M_1$, $M_2$, $M_3$, $M_4$, and $M_5$ each represents a hydrogen atom, an ammonium group, an alkaline metal atom or an organic ammonium group; and n7 represents an integer of 0 to 2, Formula (A-IV)

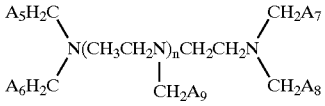

wherein, $A_5$, $A_6$, $A_7$, $A_8$ and $A_9$, which may be the same or different, each represents —$COOM_3$ or —$PO_3M_4M_5$; $M_3$, $M_4$ and $M_5$, which may be the same or different, each represents a hydrogen atom or an alkaline metal atom; and n represents an integer of 1 or 2.

5. The one-part photographic developing concentrate of claim 1, wherein the developing concentrate does not comprise any other cations than sodium ion.

6. The one-part photographic developing concentrate of claim 1, wherein the developing concentrate does not comprise a fluorescent whitening agent.

* * * * *